United States Patent [19]

Sacks

[11] 4,413,357

[45] Nov. 8, 1983

[54] PROTECTIVE SHIELDS

[76] Inventor: Michael Sacks, 43 Woodhall Ave., Whitefield, Manchester, England

[21] Appl. No.: 223,045

[22] Filed: Jan. 7, 1981

Related U.S. Application Data

[63] Continuation-in-part of Ser. No. 91,958, Nov. 7, 1979, abandoned.

[51] Int. Cl.[3] ..... F41H 1/02

[52] U.S. Cl. ..... 2/2.5

[58] Field of Search ..... 2/2.5, 2; 428/911

[56] References Cited

U.S. PATENT DOCUMENTS

| | | | |
|---|---|---|---|
| 1,276,200 | 8/1918 | Flanagan | 2/2.5 |
| 3,452,362 | 7/1969 | Korolick et al. | 2/2.5 |
| 3,557,384 | 1/1971 | Barron et al. | 2/2.5 |
| 3,567,568 | 3/1971 | Windecker | 2/2.5 X |
| 3,577,306 | 5/1971 | Baker et al. | 2/2.5 X |
| 3,577,836 | 5/1971 | Tamura | 2/2.5 |
| 3,793,648 | 2/1974 | Dorre et al. | 2/2.5 |
| 3,803,639 | 4/1974 | Cohen | 2/2.5 |
| 3,873,998 | 4/1975 | Norris et al. | 2/2.5 |
| 3,924,038 | 12/1975 | McArdle et al. | 2/2.5 X |
| 3,973,275 | 8/1976 | Blauer | 2/2.5 |

*Primary Examiner*—H. Hampton Hunter

*Attorney, Agent, or Firm*—Pearson & Pearson

[57] ABSTRACT

A protective shield such as a personal, bullet-proof garment, formed by a separable front panel and back panel, fastened together into a vest by detachable tabs, is conformable to torso movement with comfort. The outer, penetration—resisting, layer of the shield comprises at least eight and preferably twentyeight, individual superposed plies of close woven fabric of aramid fibres, the intermediate, impact-spreading layer of the shield, comprises at least one ply of thin, flexible, impervious plastic sheeting such as polycarbonate and the inner, impact-cushioning, layer of the shield is formed of soft, relatively thick, foam plastic, to absorb impact and bullet bulge of the polycarbonate sheeting.

10 Claims, 9 Drawing Figures

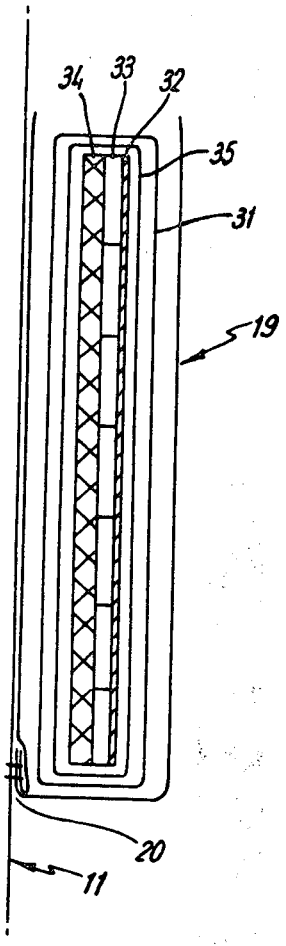
FIG. 8
FIG. 9
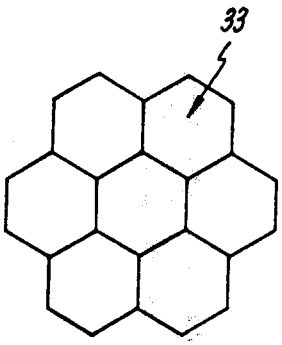

PROTECTIVE SHIELDS

CROSS REFERENCE TO RELATED APPLICATION

This application is a continuation-in-part of my U.S. Pat. application, Ser. No. 91,958 filed Nov. 7, 1979 and now abandoned.

BACKGROUND OF THE INVENTION

This invention relates to a protective shield to be used by a person to protect against injury by a bullet or other missle or moving object.

Bullet-proof shields for personal use are known which have a rigid construction. These shields can afford effective protection but are generally inconvenient and uncomfortable to use having regard to their bulk, weight and inflexibility.

Bullet-proof shields for personal use are also known which have a flexible construction being formed from penetration-resisting fabrics. With this shield, however, it is difficult to limit the risk of serious injury to the user whilst at the same time maintaining low weight, reduced bulk and appreciable flexibility. This is because the penetration-resisting fabric tends to bulge at the back of the shield in the vicinity of an impact thereby to transmit appreciable shock in such region to the user's body.

SUMMARY OF THE INVENTION

An object of the present invention is to overcome the aforementioned difficulty which arises with flexibly constructed shields.

According to the present invention, therefore, there is provided a protective shield to be used by a person to protect against injury by a bullet or other missile or moving object, said shield comprising a sandwich of layers within an outer cover adapted to be worn in front of the person's body, said layers comprising:

a penetration-resisting layer made up of one or more flexible sheets of a closely woven fabric which is made from aramid fibres of high tensile strength and high stretch resistance such as to be capable of resisting penetration by a bullet, and a backing layer made up of one or more thin, flexible sheets of a semi-stiff impervious plastics material said sheet or sheets of said backing layer being formed separately to but being secured in position relative to said sheet or sheets of said penetration-resisting layer on that side of said penetration-resisting layer which faces towards the person's body, whereby when struck with a bullet or missile or other moving object, said penetration-resisting layer acts to prevent or limit penetration whilst said backing layer acts to limit transmission of impact shock to the person's body.

With this arrangement surprisingly, it has been found that the sheet or sheets of the backing layer can act to absorb and spread shock produced on impact and thereby limit the localized transmission of large forces to the user's body.

The aramid material may be that sold by DuPont under the tradename Kevlar.

The said sheet or sheets of said backing layer may comprise one or more polycarbonate sheets. An auxiliary backing layer may also be provided which is made up of one or more sheets of a resiliently compressible foamed plastics material. Additionally, if desired a further impact absorbing backing layer may be provided which is made up of one or more sheets of felted aramid fibres.

If desired, impact absorbing material may also be provided at the front of the said fabric, that is at the side thereof which in use faces away from the person's body, such material being as mentioned in the preceding paragraph and/or comprising a layer of steel or like strong material.

The various layers of the shield may be secured together by stitching and/or bonding and/or may be enclosed in a bag such as a plastics bag or fabric bag to form what I call a ballistic pack. The shield may be shaped as desired and thus for example may be shaped to fit against a person's body. In one embodiment the shield is in the form of a garment such as a vest.

BRIEF DESCRIPTION OF THE DRAWINGS

The invention will now be described further by way of example only and with reference to the accompanying drawings in which:

FIGS. 6, 7 and 8 are views corresponding to FIGS. 1, 2 and 3 of a modification;

FIG. 9 shows a detail of the arrangement of FIG. 8.

DESCRIPTION OF THE PREFERRED EMBODIMENT

The shield has front and back shaped portions A, B which can be held together by engagement of Velcro (Registered Trademark) attachment devices on the ends of tabs C1, C2 on the back portion B with co-operable Velcro attachment devices on pads D1, D2 on the front portion. When the portions are held together they define a vest-shaped garment V with a front lower depending portion E to provide groin protection.

More specifically, the portion A is positioned over the front of a person's trunk with the pads D1 in the region of the person's shoulders and the portion E projecting in front of his groin region; the portion B is positioned over the back of the person's trunk; and the portions A, B are attached together by bringing the tabs C1 from behind over the person's shoulders to effect interengagement of the Velcro attachment devices on the tabs C1 and the pads D1, and by bringing the tabs C2 and adjacent side portions G around the person's sides to effect interengagement of the Velcro attachment devices on the tabs C1 and the pads D2.

Figure 2:
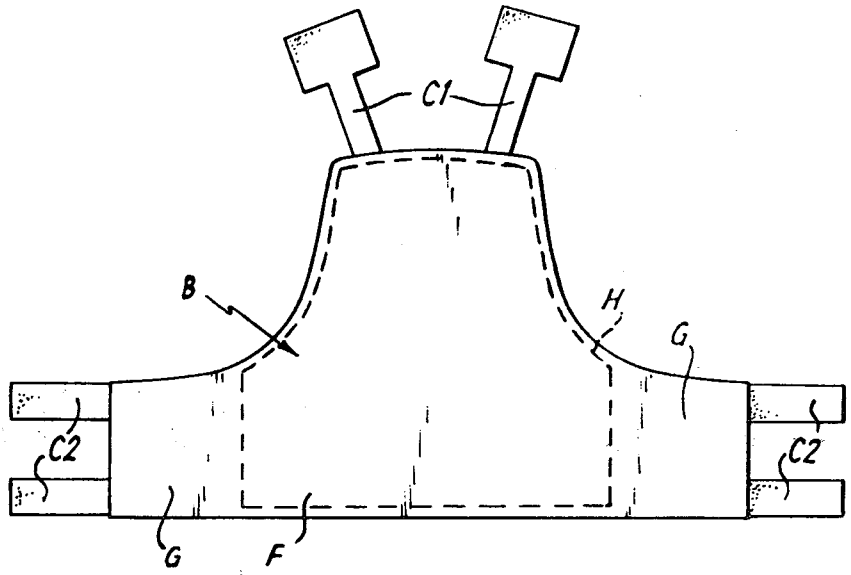
FIGS. 1 and 2 are front and back portions of one form of a shield according to the invention in the form of a vest.
Figure 3:
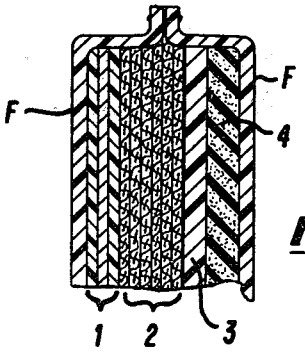
FIG. 3 is a sectional representation to an enlarged scale of part of the shield.

Each portion A, B comprises a peripherally sealed nylon bag F (FIG. 3) containing a respective shaped sandwich (as indicated by the broken lines H, I, in FIGS. 1 and 2) made up of four layers, 1, 2, 3 and 4 which constitute from front to back in one embodiment shown in FIG. 3:

First layer (reference number 1):

Two sheets of fabric woven from Kevlar (say Kevlar 29 or 49 woven with 31—31 (warp and weft) picks per inch (2.54 cms) from 1000 or 1500 denier yarn) with a layer of thin flat steel elements, which may be hexagon shaped, secured between the Kevlar sheets, the steel elements and Kevlar sheets being bonded together.

Second layer (reference numeral 2):

A number of sheets of Kevlar fabric (as described above). Preferably 8 to 30 sheets are used as individual fabric sheets stitched together and/or as pairs of sheets bonded together, separate such pairs being stitched together. Sixteen individual fabric sheets with six bonded pairs may be used (giving a total of 28 sheets).

Third layer (reference numeral 3):

One or two (or more if desired) thin flexible polycarbonate sheets. One or more sheets of the transparent polycarbonate sold under the tradename LEXAN may be used, they or each such sheet being of 0.75 mm thickness.

Fourth layer (reference numeral 4):

One (or more if desired) resiliently compressible sheet of a foamed plastics material. A foamed, cross-linked polyethylene such as that sold under the tradename PLASTAZOTE or EVAZOTE may be used. The total thickness of the plastics sheet or sheets may be 0.5 mm to 12 mm.

Figure 1:
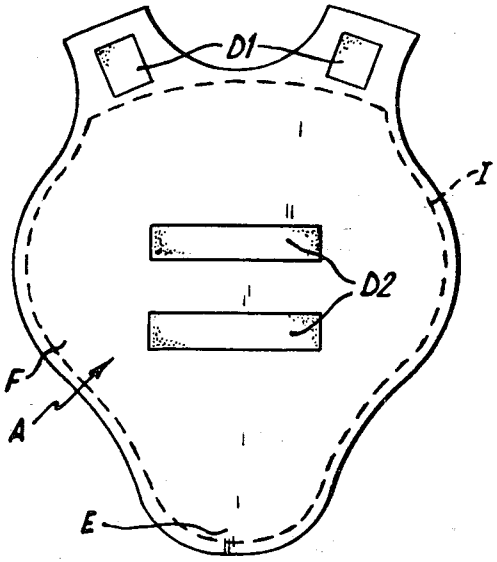
Figure 4:
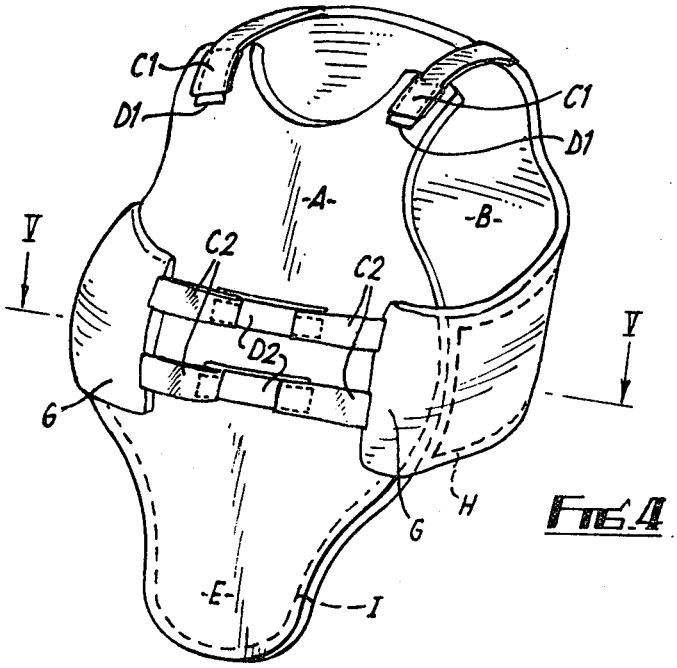
FIG. 4 is a front perspective view of a vest-like garment of the invention.
Figure 5:
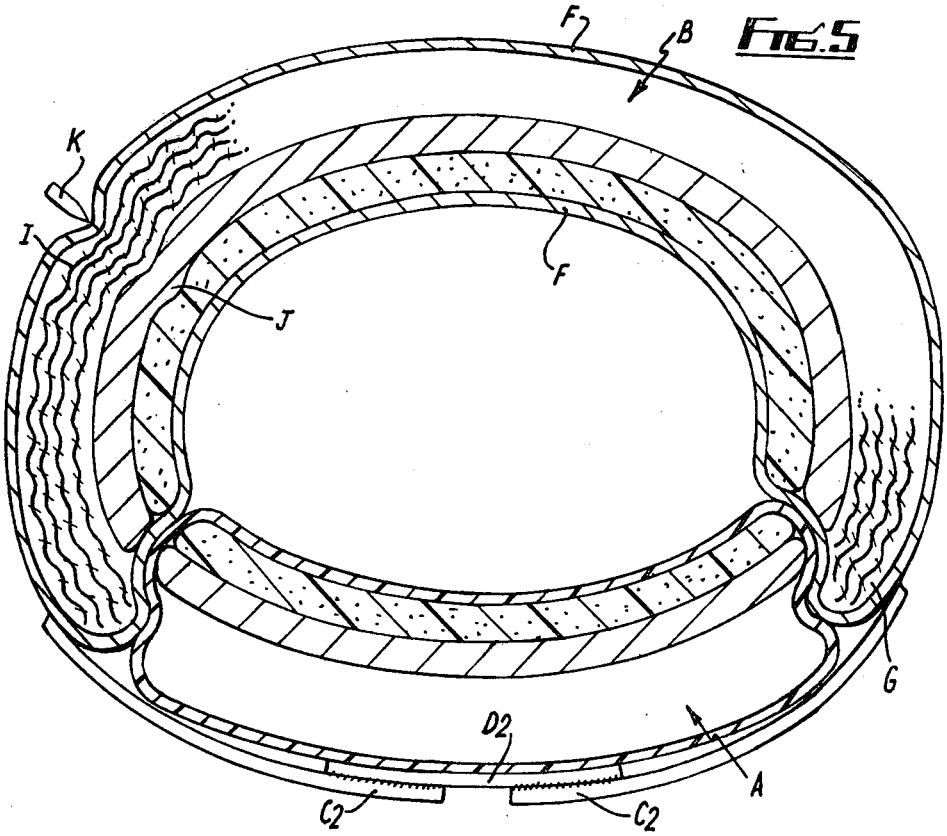
FIG. 5 is a diagrammatic plan view, in section on line 5—5 of FIG. 4, with the multiple plies greatly enlarged and showing the effect of a bullet on the garment.

In the preferred embodiment of the invention, the vest-like garment V of the invention is formed of a separate front panel A and rear panel B, both normally in a flat, plane as shown in FIGS. 1 and 2, but both being bendable into gentle curves to conform to the curves of the human torso, as shown in FIGS. 4 and 5. The VELCRO hook and pile fastening tabs, extending over the shoulders and around the waist, maintain the wrap around effect during use because of the inherent flexibility of the thin, polycarbonate sheeting, which permits slight bending of the sheeting. The sandwich of layers, or plies, of FIG. 5, does not include the first layer 1, with its steel elements and instead constitutes an outer, penetration-resisting layer 2 formed of at least eight, and preferably up to twentyeight, individual plies of flexible fabric closely woven from "KEVLAR" superposed on each other and each ply being KEVLAR 29 to 49 woven with 31—31 (warp and weft) picks per inch (2.54 cms) from 1000 or 1500 denier yarn of aramid fibres, the aramid fibres being or high tensile strength and high stretch resistance.

At least one intermediate, impact spreading, or backing, layer 3, formed of thin, flexible, impervious, plastic sheets of polycarbonate which are semi-stiff but thin enough to bend to conform to the shape of the human torso in the vest-like garment V. Transparent polycarbonate sold under the tradename LEXAN may be used, each sheet 3 being of 0.75mm thickness.

At least one, relatively thick, inner, impact cushioning, or auxiliary layer 4, formed of soft, foam plastic which is resiliently compressible to prevent injury to the skin of the body when a bullet bulge J occurs in the layer (FIG. 5) from a bullet K.

These layers (1, 2, 3, 4) are separate to each other but are fixed relative to each other as aforementioned. All sheets of the layers (1, 2, 3, 4) are superimposed on each other and are of like size and shape (as indicated) by lines (H, I). With this arrangement the vest when worn by a person can effectively protect the person against injury when struck with a bullet or other missile or moving object. In this respect, the Kevlar sheets act to prevent or limit penetration whilst the polycarbonate and foamed plastics sheets absorb impact shock and limit transmission thereof to the person's body.

It is of course to be understood that the invention is not intended to be restricted to the details of the above embodiment and thus, for example, it will be appreciated that parameters such as the the thickness of the various layers, the number of individual sheets in the layers, and so on will be selected in accordance with requirements.

Figure 6:
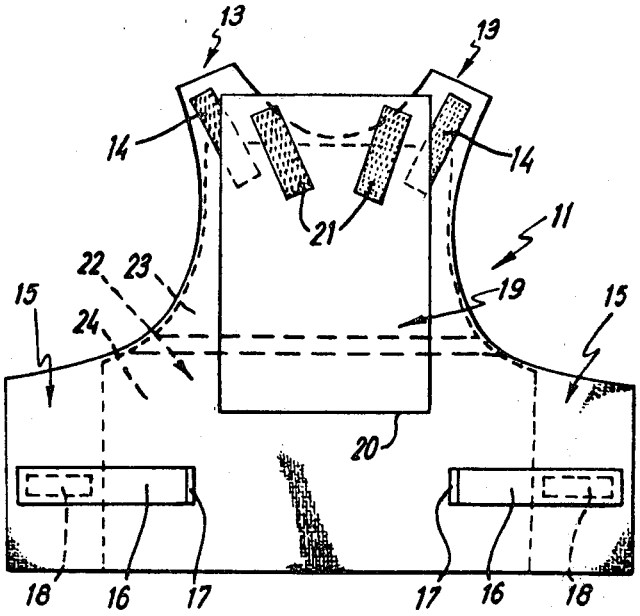
Figure 7:
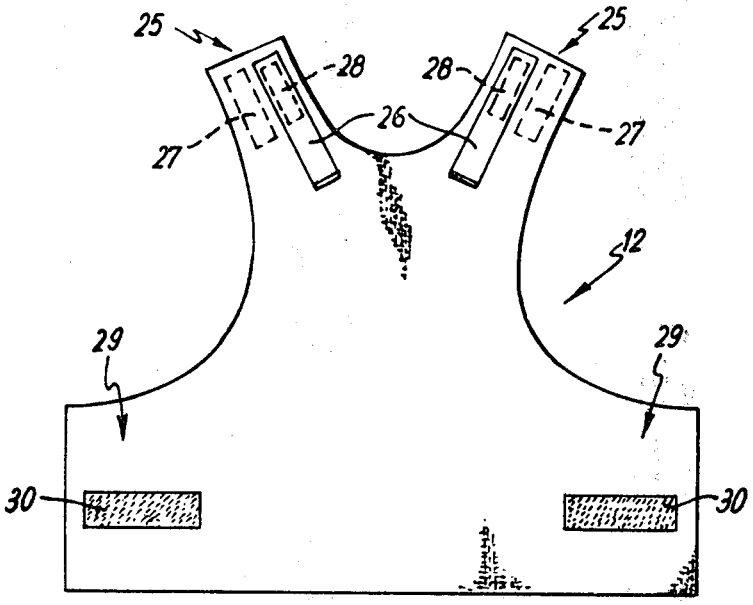

In a modification of the above embodiment, as shown in FIGS. 6, 7, 8 front and back shaped portions 11, 12, which are formed from stitched fabric (such as nylon), can be held together by engagement of Velcro (Registered Trademark) pads to define a vest-shaped garment.

The front portion 11 has shoulder parts 13 provided respectively with two Velcro pads 14, and also two side flaps 15 provided respectively with two tabs 16 thereon. Such tabs 16 overlie the flaps 15 and are fixed to the front portion 11 at the two ends 17 of the tabs which face each other. The tabs 16 have Velcro pads 18 on the undersides of the free ends thereof.

The front portion 11 also has an open-topped pouch 19 overlying the breast region and stitched in position at its bottom edge 20. Velcro pads 21 are provided at the top of the pouch. A pocket 22 (as shown in dotted lines in FIG. 6) is provided on the inside of the front portion, such pocket being defined by overlapping inner sheets 23, 24 of fabric which are stitched to the front portion 11 around the edges thereof and which define a pocket opening between the central overlapping free edges thereof.

The back portion 12 has shoulder strips 25 with overlying tabs 26 fixed in position at their lower ends only. Velcro pads 27, 28 are provided on the undersides of the strips 25 and the tabs 26. There are also side flaps 29 with Velcro pads 30 thereon.

In use, the front and back portions 11, 12 are positioned in front of and behind a person with the side flaps 29 of the back portion 12 overlying the side flaps 15 of the front portion 11, the shoulder strips 25 overlying the shoulder parts 13, the tabs 26 overlying the pouch 19, and the tabs 16 overlying the flaps 29. The superimposed Velcro pads 14 and 27, 21 and 28, 18 and 30 are engaged with each other to hold the portions 11, 12 together.

Before fitting the front and back portions 11, 12 protective shields are incorporated therein, such shields comprising front and back shields which are inserted respectively within the pouch 19 and the pocket 22.

The front shield, as shown in FIG. 8, comprises a peripherally sealed nylon bag 31 containing three rectangular layers, 32, 33, 34 from front to back:

First layer (reference numeral 32)

One or more thin flexible sheets of the transparent polycarbonate sold under the trade name LEXAN, the or each such sheet being of 0.75 mm thickness.

Second layer (reference numeral 33)

A layer of hexagonal ceramic plates (say about 7 mm thick and about 75 mm across) formed for example from Refel (a self-bonded silicon carbide manufactured and sold by British Nuclear Fuels Limited, having a hardness in the range 2500–3500 $Kg/mm^2$ and a rupture modulus of about 525 $MN/m^2$ (76000 p.s.i.)). As shown in FIG. 9, the plates are placed edge-to-edge and also they are bonded to the next described layer 34. The first described layer 32 may also be bonded to the plates. As a bonding agent a thick silicone rubber, such as Berger Silicone 381 may be used.

Third layer (reference numeral 34)

One or more sheets (say 10 sheets) of a coarse Kevlar fabric. The sheets may be bonded together (with the above described bonding agent) to give a stiff laminate.

Within the bag 31 a sheet of Kevlar 35 is wrapped around the layers 32–34.

The rear shield inserted into the pocket 22 is identical with the shield described above and shown in FIG. 3.

The embodiment of FIGS. 6 to 8 is particularly suitable for protection against high velocity bullets. When a high velocity bullet strikes the front shield in the pouch 19, the bullet hits the ceramic plates causing these to shatter and the bullet to fragment. Small pieces of the bullet now moving at a much reduced velocity may penetrate the front shield but are then stopped by the back shield in the pocket 22 in the manner hereinbefore described with reference to the embodiment of FIGS. 1 to 3. The layer 32 protects the plates 33 against breakage for example if the shield is accidentally dropped or roughly handled. The sheet 35 holds the plates 33 together after impact so that some protection can be afforded against a subsequent impact. The layer 34 acts to support the plates 33.

In place of the ceramic silicon carbide plates it is possible to use alumina ceramic plates (such as Sintox manufactured and sold by Smiths Industries Limited) or any other supported rigid brittle material having a high degree of hardness. Preferably such material is a glass or ceramic material although steel or any other material having the requisite properties may be used. Preferably also small plates placed edge-to-edge are used although it may also be possible to use a one-piece sheet. In order to facilitate cracking of the material in a predetermined manner on impact, small holes or other points or lines of weakness may be provided therein.

The tabs 26 used to secure the upper part of the front pouch to the front part of the vest may be of sufficient length and/or may be formed from an elastic material such as to permit a degree of movement of the pouch relative to the vest part behind same. In this way movement of the wearer and in particular normal breathing movements of the wearer's chest need not be unduly restricted despite the weight and rigidity of the layers within the pouch.

What is claimed is:

1. A lightweight protective garment to be worn by a person to protect against injury by a bullet or other missile or moving object, said garment having front and back portions and means for interconnecting said portions at the sides and over the shoulders of said person so that the garment can be worn in the manner of a vest, said front portion having supported thereon a ballistic pack arranged to extend over an area at the front of said person's body, said ballistic pack comprising a sandwich of layers within an outer cover, said layers comprising: a penetration-resisting layer made up of a plurality of flexible sheets of a closely-woven fabric formed from aramid fibres of high tensile strength and high stretch resistance such as to be capable of resisting penetration by a bullet, and a backing layer made up of one or more thin, flexible sheets of a semi-stiff impervious plastics material, said backing layer being formed separately to but being held in position relative to said sheet or sheets of said penetration-resisting layer on that side of said penetration-resisting layer which faces towards the person's body, whereby when struck with a bullet or missile or other moving object, said penetration-resisting layer acts to prevent or limit penetration whilst said backing layer acts to limit transmission of impact shock to the person's body.

2. A garment according to claim 1, wherein said sheet or sheets of said backing layer comprise one or more polycarbonate sheets.

3. A garment according to claim 1, wherein the said sandwich further includes an auxiliary layer made up of one or more sheets of a resiliently compressible foamed plastics material, said auxiliary layer being provided on that side of the penetration-resisting layer which faces towards the person's body and being adapted to supplement the action of the said backing layer with regard to the limiting of impact shock transmission.

4. A lightweight protective garment to be worn by a person to protect against injury by a bullet or other missile or moving object, said garment having front and back portions and means for interconnecting said portions at the sides and over the shoulders of said person so that the garment can be worn in the manner of a vest, said front portion having supported thereon a ballistic pack arranged to extend over an area at the front of said person's body, said ballistic pack comprising a sandwich of layers within an outer cover, said layers comprising: a penetration-resisting layer made up of a plurality of flexible sheets of a closely-woven fabric formed from aramid fibres of high tensile strength and high stretch resistance such as to be capable of resisting penetration by a bullet, and an impact-absorbing backing layer, said backing layer being formed separately to, but being held in position relative to said sheet or sheets of said penetration-resisting layer on that side of said penetration-resisting layer which faces towards the person's body, whereby when struck with a bullet or missile or other moving object, said penetration-resisting layer acts to prevent or limit penetration whilst said backing layer acts to limit transmission of impact shock to the person's body and said front portion also having supported thereon in front of the said ballistic pack an auxiliary shield formed separately from said ballistic pack, said shield comprising a layer of a rigid brittle material having a high degree of hardness which is bonded to a supporting layer comprising one or more sheets of a closely-woven fabric made from aramid fibre of high tensile strength and high stretch resistance.

5. A protective garment according to claim 4, wherein the said brittle material comprises glass or ceramic plates placed edge to edge.

6. A protective garment according to claim 4, wherein a pouch is secured to the front of said front portion and said auxiliary shield is removable supported within said pouch.

7. A garment according to claim 4, wherein said backing layer of said ballistic pack comprises one or more thin, flexible sheets of a semi-stiff impervious plastics material.

8. A garment according to claim 7, wherein said sheet or sheets of said backing layer comprise one or more polycarbonate sheets.

9. A garment according to claim 7, wherein said sandwich of said ballistic pack further includes an auxiliary layer made up of one or more sheets of a resiliently compressible foamed plastics material behind said backing layer.

10. A lightweight, armored vest for protecting the wearer against body penetration by a bullet and against blunt trauma from the impact of a bullet, said vest having a front portion and a rear portion and connection means joining said portions into a vest covering the upper torso of the wearer, each said portion being formed by an outer cover containing from eight to thirty superposed sheets of flexible, penetration-resistant fabric closely woven with about 31—31 (warp and weft) picks per inch (2.54 cms) from 1000–1500 denier aramid yarn, said sheets being attached to each other as a multi-layered sandwich to prevent bullet penetration, and said cover containing at least one, thin flexible polycarbonate sheet, about 0.75 mm in thickness, co-extensive in area with the area of said multi-layered sandwich of aramid yarn sheets, as a backing layer for said penetration, resistant layers to absorb and spread shock impact and prevent blunt trauma, from a bullet.

* * * * *